US006129521A

United States Patent [19]

Heikens

[11] Patent Number: 6,129,521

[45] Date of Patent: Oct. 10, 2000

[54] SAFETY VALVE APPARATUS FOR AIR PRESSURE OPERABLE DIAPHRAGM PUMP

[75] Inventor: Gerard Heikens, Tokyo, Japan

[73] Assignee: Yamada Corporation, Tokyo, Japan

[21] Appl. No.: 09/173,757

[22] Filed: Oct. 16, 1998

[30] Foreign Application Priority Data

Aug. 3, 1998 [JP] Japan ..... 10-218857

[51] Int. Cl.[7] ..... F04B 49/00; F04B 23/00

[52] U.S. Cl. ..... 417/295; 417/298; 417/441

[58] Field of Search ..... 417/295, 298, 417/441, 393, 395; 137/494; 251/335.3

[56] References Cited

U.S. PATENT DOCUMENTS

| | | | |
|---|---|---|---|
| 3,923,425 | 12/1975 | Porter et al. | 417/298 |
| 4,201,366 | 5/1980 | Danko et al. | 251/335.3 |
| 5,220,943 | 6/1993 | Zink | 251/335.3 |
| 5,429,484 | 7/1995 | Honda et al. | 417/398 |
| 5,480,292 | 1/1996 | Chevallier | 417/393 |
| 5,807,085 | 9/1998 | Yajima | 417/505 |
| 5,842,611 | 12/1998 | Vivier | 222/256 |

*Primary Examiner*—Charles G. Freay
*Assistant Examiner*—Michael K. Gray
*Attorney, Agent, or Firm*—Wenderoth, Lind & Ponack, L.L.P.

[57] ABSTRACT

A safety valve apparatus (25) for feeding predetermined liquid (21) from a tank (22) to a diaphragm pump (1) in which a central rod (3) is reciprocally slidable by air pressure to forcibly pump out the liquid. The safety valve apparatus includes a housing (27, 28, 29) having a space (40) including a liquid balance port (28*a*) that is always in communication with the liquid in the tank, and a liquid chamber (31) including a liquid flow-in port (29*a*) into which the liquid from the tank flows, and a liquid flow-out port (29*b*) from which the liquid from the tank flows out. A valve rod slidably passes through the housing and is provided at its end near the liquid chamber (31) with a valve body (45) that is capable of being seated in the flow-in port (29*a*). Also, a diaphragm (34) is disposed within space (40) so as to be attached between the valve rod (32), which protrudes into the space (40), and an inner peripheral wall of the space. The diaphragm partitions the space (40) into at least a liquid balance chamber (41), communicating with the liquid balance port (28*a*), and another chamber (42). In this case, an effective liquid pressure receiving area of the diaphragm (34) is larger than an effective liquid pressure receiving area of the valve body (45), such that, when the diaphragm pump is in an inoperative condition, the valve rod (32) slides toward the liquid chamber (31) to close the liquid flow-in port (29*a*), and, when the diaphragm pump is operated to generate negative pressure in the liquid chamber (31), the valve rod (32) slides toward the liquid balance chamber (41) to open the liquid flow-in port (29*a*). Accordingly, if the diaphragm pump is damaged, the safety valve prevents liquid from flowing toward the diaphragm pump and contaminating the surrounding environment.

6 Claims, 4 Drawing Sheets

SAFETY VALVE APPARATUS FOR AIR PRESSURE OPERABLE DIAPHRAGM PUMP

BACKGROUND OF THE INVENTION

The present invention relates to a safety valve apparatus for an air pressure operable diaphragm, and more particularly, relates to a safety valve apparatus for an air pressure operated diaphragm in which liquid such as chemicals (for example, medical liquid) can be prevented from leaking out of the diaphragm pump to contaminate a surrounding environment even if the diaphragm pump is damaged, and a service life of the diaphragm pump can be improved.

Generally, in some medical liquid plants, medical liquid supplied from a tank is supplied to a desired position by a diaphragm pump.

The diaphragm pump has, for example, a construction of a so-called double diaphragm type as shown in FIG. 1. In FIG. 1, a central rod 3 is disposed along an axis of a pump body 2 of a diaphragm pump 1 and is slidable in a left-and-right direction. By diaphragms 4 and 5, which are attached to both ends of the central rod 3, an inner chamber 6*a* and an outer chamber 7*a*, and an inner chamber 6*b* and an outer chamber 7*b* are defined at left and right sides, respectively. The pump body 2 cooperates with the central rod 3 to provide a switch valve function for switching an air flow direction. To this end, there are provided an air inlet port 8, an air outlet port 9, other air inlet and outlet ports 10, 11, a liquid flow-in port 12, a liquid flow-out port 13 and four check valves 14.

In operation, as shown by the arrow in FIG. 1, when compressed air from the air inlet port 8 enters the left inner chamber 6*a* through the port 10, since the left diaphragm 4 is pushed leftwardly, the central rod 3 is slid leftwardly, with the result that a volume of the outer chamber 7*a* is compressed. Accordingly, due to the presence of the check valves 14, liquid in the outer chamber 7*a* is pushed out upwardly in FIG. 1 and is forcibly flown out (or pumped out) through the liquid flow-out port 13. Meanwhile, air in the right inner chamber 6*b* flows into the atmosphere from the outlet port 9 through the port 11. Consequently, since the right outer chamber 7*b* is expanded to generate negative pressure, the liquid flows into the expanded chamber from the liquid flow-in port 12 through the check valve 14. Then, when compressed air from the port 11 enters the right inner chamber 6*b*, similarly, liquid in the outer chamber 7*b* is pushed out upwardly in FIG. 1 to be forcibly flown out (or pumped out) through the flow-out port 13. Meanwhile, liquid flows into the left outer chamber 7*a* through the flow-in port 12. In this way, the liquid is forcibly fed from the flow-in port 12 to the flow-out port 13 continuously, thereby pumping-out the liquid. Incidentally, a tank (not shown) has a predetermined (water) head with respect to the liquid flow-in port 12 of the diaphragm pump, and thus constant liquid pressure from the tank always acts on the flow-in port 12.

Now, a switching operation for the sliding direction of the central rod 3 will be explained with reference to FIG. 2. As shown in FIG. 2, when the central rod 3 is slid to the left to reach a left slide limit position while pushing the liquid out of the left outer chamber 7*a* by the action of the diaphragm 4, the diaphragm 4 is deformed to an outwardly convex configuration 4*a* under the action of the compressed air in the left inner chamber 6*a*. Immediately after that, since both the supply of the compression air to the right inner chamber 6*b* (FIG. 1) and the discharge of the compressed air from the left inner chamber 6*a* are started, the central rod 3 starts to be slid rightwardly, with the result that the liquid from the tank starts to be sucked into the left outer chamber 7*a*. However, this creates the following problems.

① In FIG. 2, when the central rod 3 starts to be slid rightwardly, i.e., when a liquid sucking stroke for the left outer chamber 7*a* is started, since the constant liquid pressure from the tank becomes to act on the left outer chamber 7*a*, as air pressure in the left inner chamber 6*a* is reduced, the diaphragm 4 is suddenly reversed toward the inner chamber 6*a* (i.e., air chamber) to assume a reverse configuration 4*b* as shown by the broken lines in FIG. 2. During the continuous operation of the pump, if this phenomenon is repeated, fatigue of the diaphragm will be increased or the diaphragm will be damaged, with the result that the service life and reliability of the pump will be detrimentally affected.

② If the diaphragm is damaged for the reason as mentioned in the above item ① or other reason, since the outer chamber 7*a* and the inner chamber 6*a* would communicate with each other, the liquid acting on the flow-in port 12 with the constant pressure leaks from the air outlet port 9 through the check valve 14, outer chamber 7*a*, inner chamber 6*a* and air flow passage to the exterior, thereby contaminating the surrounding environment.

A first object of the present invention is to provide a safety valve apparatus for an air pressure operable diaphragm in which a diaphragm of a diaphragm pump can be reciprocated while maintaining an outwardly convex configuration, and, accordingly, the service life and reliability can be improved without generating the fatigue or crack in the diaphragm.

A second object of the present invention is to provide a safety valve apparatus for an air pressure operable diaphragm in which, even if a diaphragm of a diaphragm pump is damaged for any reason, the pressure in the liquid chamber is brought to atmospheric pressure, and the liquid flow-in port of the safety valve apparatus is immediately closed to block the further flowing-out of the liquid from the diaphragm pump to the exterior, thereby preventing the danger of contaminating the surrounding environment, while maintaining a clean environment.

SUMMARY OF THE INVENTION

The present invention provides a safety valve apparatus 25 for feeding predetermined liquid 21 from a tank 22 to a diaphragm pump 1 in which a central rod 3 to which at least one pumping diaphragms 4, 5 are attached is reciprocally slid by air pressure to forcibly pumping out the liquid, the safety valve apparatus comprising a housing 27, 28, 29 having a space 40 including a liquid balance port 28*a* always communicating with the liquid in the tank, and a liquid chamber 31 including a liquid flow-in port 29*a* into which the liquid from the tank flows and a liquid flow-out port 29*b* from which the liquid from the tank flows out, and a valve rod 32 slidably passing through the housing and protruding into the liquid chamber 31. A valve body 45, provided on an end of the valve rod 32, is capable of being seated on the flow-in port 29*a*. Also, a diaphragm 34 is disposed within the space 40 so as to be attached between portion of the valve rod protruding into the space 40 and an inner peripheral wall 40*a* of the space. The diaphragm 34 partitions the space 40 into at least a liquid balance chamber 41 communicating with the liquid balance port 28*a* and another chamber 42. An effective liquid pressure receiving area of the diaphragm 34 is larger than an effective liquid pressure receiving area of the valve body 45, such that, when the diaphragm pump is in an inoperative condition, the valve rod 32 is slid toward the liquid chamber 31 to close the liquid flow-in port 29*a*, and, when the diaphragm pump is operated to generate negative pressure in the liquid chamber 31, the valve rod 32 is slid toward the liquid balance chamber 41 to open the liquid flow-in port 29*a*.

With an arrangement as mentioned above, since the liquid flow-in port is opened to allow the liquid to be supplied from the tank to the diaphragm pump only when the negative pressure is generated in the liquid chamber, the negative pressure is generated in the outer chamber at the liquid suction side of the diaphragm pump, with the result that there is no reverse phenomenon of the diaphragm. If the diaphragm is damaged to allow the outer chamber 7 and the inner chamber 6 to be communicated with each other, since the pumping function caused by the shifting of the diaphragm is blocked, the negative pressure is not generated in the liquid chamber, with the result that, since the flow-in port is not opened, the environment surrounding the diaphragm pump is not contaminated.

Preferably, the another chamber 42 is an air chamber 42 for containing air communicating with the atmosphere. Thus, under the spring action of the air in the air chamber, the sliding movement of the valve rod 32 is effected smoothly.

Further, preferably, a bellows for sealingly closing a predetermined length portion of the valve rod at the liquid chamber side with respect to the liquid chamber under a liquid-tight condition is attached within the liquid chamber. With this arrangement, the liquid flowing from the liquid flow-in port 29*a* is prevented from striking against the valve rod 32 for a long term to damage the valve rod mechanically or chemically, or, the liquid in the liquid chamber 31 is prevented from flowing into the air chamber 42 through a bearing 33 to leak externally from an air passage 27*a*.

Preferably, the bellows is secured to the valve body via a torsion ring 44. With this arrangement, an attaching condition of the bellows is stabilized to improve the reliability.

DESCRIPTION OF THE PREFERRED EMBODIMENTS

Figure 3:
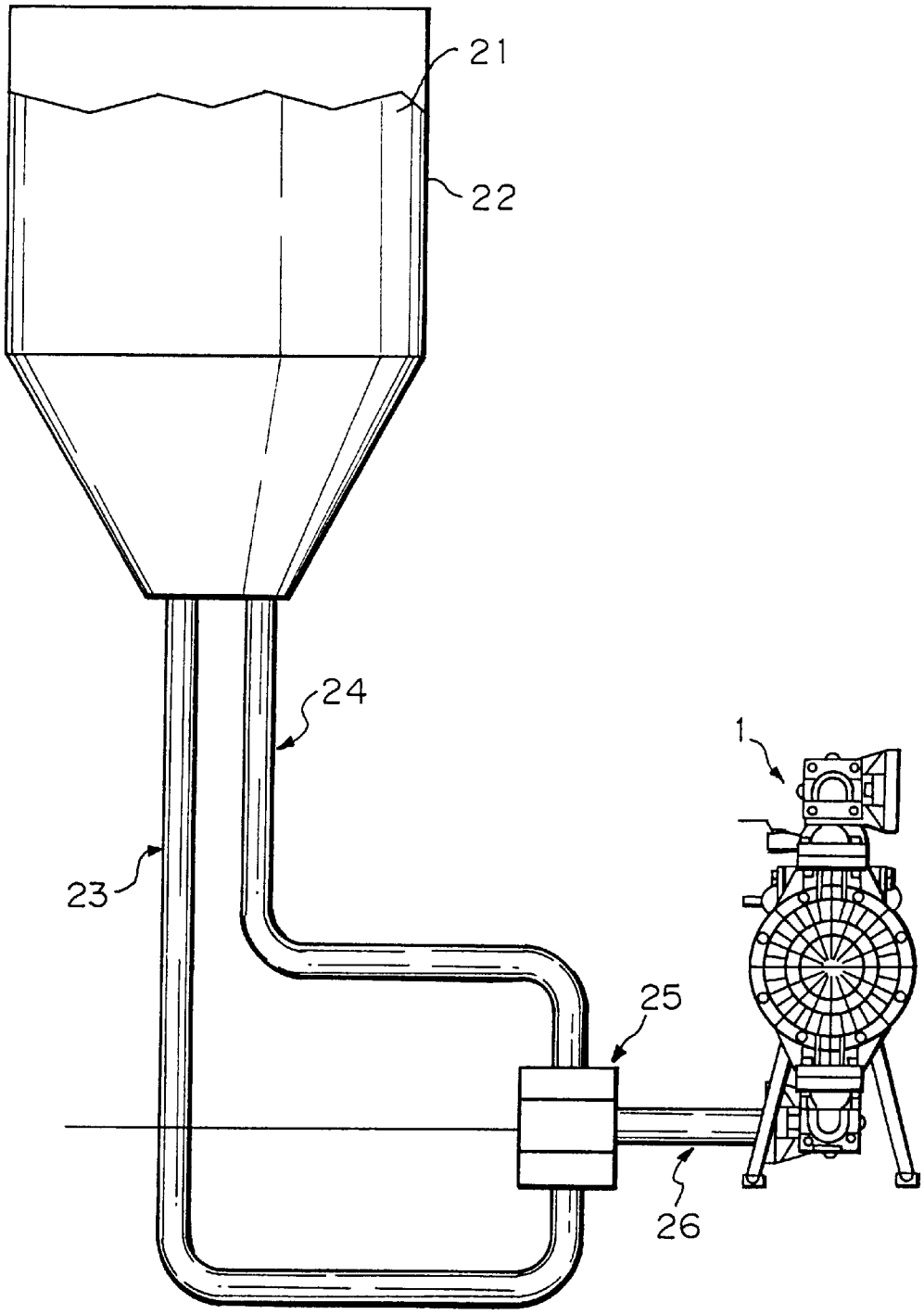
FIG. 3 is a schematic view showing an example of a liquid pumping system incorporating a safety valve apparatus for an air pressure operated diaphragm pump according to a preferred embodiment of the present invention.

FIG. 3 is a schematic view showing an example of a liquid pumping system provided with a safety valve apparatus for an air pressure operated diaphragm pump according to a preferred embodiment of the present invention.

In FIG. 3, a tank 22 for containing liquid 21 such as predetermined medical liquid is connected to the safety valve apparatus 25 through a liquid flow-in pipe 23 and a balance liquid pipe 24, and the safety valve apparatus 25 is also connected to the diaphragm pump 1 through a liquid communication pipe 26.

Figure 4:
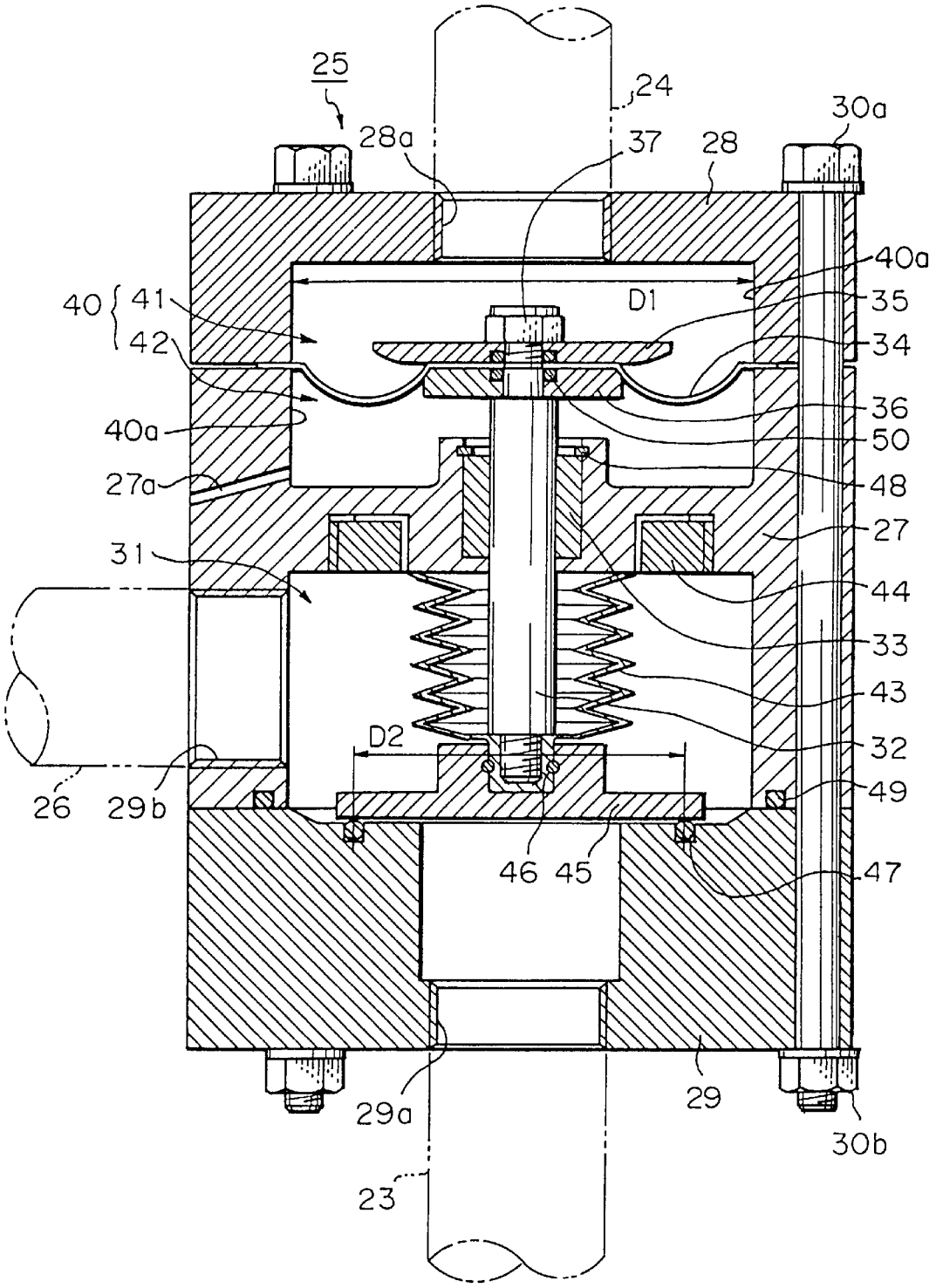
FIG. 4 is a longitudinal sectional view of the safety valve apparatus of FIG. 3.

FIG. 4 shows the safety valve apparatus 25 in detail. In FIG. 4, a main housing 27 is connected to an upper housing 28 and a lower housing 29 via bolts 30*a* and nuts 30*b* so that a predetermined space 40 is defined between the main housing 27 and the upper housing 28 and a liquid chamber 31 is defined between the main housing 27 and the lower housing 29.

A valve rod 32 extends through a bearing 33 of the main housing 27 along an axis of the main housing 27 and is slidable in an up-and-down direction in FIG. 4. A diaphragm 34 is interposed between two discs 35 and 36 attached to an upper part of the valve rod 32 and is secured to the discs by a bolt 37, and an outer peripheral edge of the diaphragm is pinched between the housings 28 and 27, so that the space 40 is divided into a liquid-tight upper liquid balance chamber 41 and an air-tight lower air chamber 42. The air chamber 42 is communicated with the atmosphere through an air passage 27*a*.

A bellows 43 is freely fitted on the valve rod 32 within the liquid chamber 31 and has an upper end secured to the main housing 27 via a screw ring or torsion ring 44 and a lower end threadingly secured to a lower end of the valve rod 32. A valve body 45 is secured to the lower end of the bellows 43 via a lock ring 46 and is seated on an O-ring 47 of the lower housing 29 (but, can be disengaged from the O-ring). Incidentally, the reference numeral 48 denotes a lock ring for securing the bearing 33; and 49, 50 denote sealing O-rings.

In FIG. 4, the liquid flow-in pipe 23 and the liquid communication (flow-out) pipe 26 are connected to a liquid flow-in port 29*a* and a liquid flow-out port 29*b* of the lower housing 29, respectively. The balance liquid pipe 24 is connected to a balance port 28*a* of the upper housing 28 to always communicate with the liquid balance chamber 41, thereby supplying balancing liquid from the tank 22. In the arrangement shown in FIG. 4, although hydraulic pressures per unit area of the liquid (from the tank 22) acting on the flow-in port 29*a* and the balance port 28*a* are substantially the same, since an inner diameter D1 of the liquid balance chamber 41 is larger than a seating diameter D2 of the valve body 45 against the O-ring 47 (D1>D2), a force for pushing the valve rod 32 downwardly (FIG. 4) overcomes a force for pushing the valve rod upwardly, with the result that the valve rod 32 reaches a lower slide limit position (where the valve body 45 is seated on the O-ring 47) due to the pressure difference (referred to as P1) between the two pushing forces. In this way, the liquid flow-in pipe 23 is closed to block the liquid 21 from the tank 22.

Next, an operation of the safety valve apparatus 25 will be explained.

Figure 1:
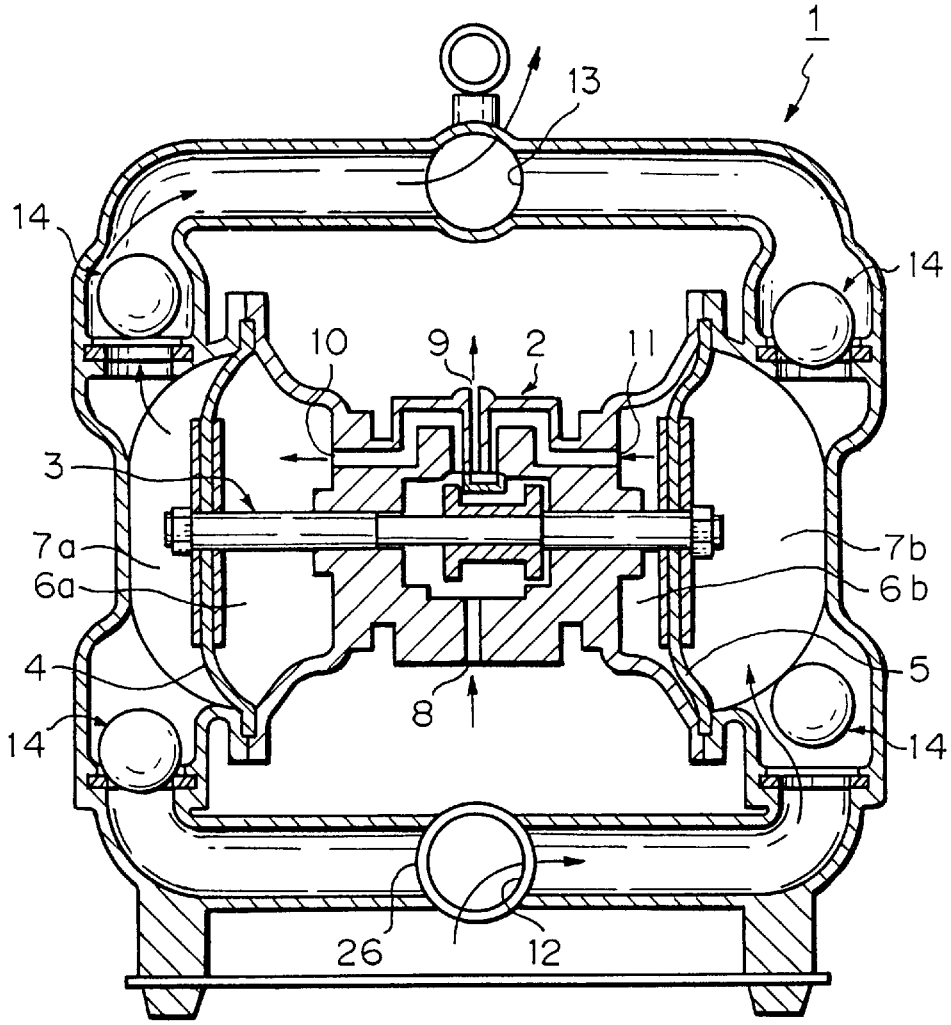
FIG. 1 is a sectional view of a general air pressure operated diaphragm pump.
Figure 2:
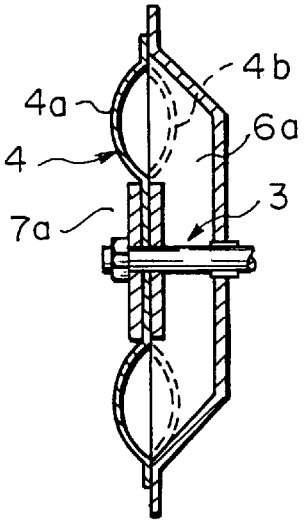
FIG. 2 is a view showing an operation of a main portion of the pump of FIG. 1.

When the diaphragm pump 1 shown in FIG. 1 is operated to slide the central rod 3 to the left in FIG. 1, for example, the liquid in the left outer chamber 7*a* is pushed out and the negative pressure is generated in the right outer chamber 7*b* to cause the liquid to flow into the right outer chamber 7*b*, with the result that the negative pressure is also generated in the liquid chamber 31 of the safety valve apparatus 25 through the communication pipe 26. Accordingly, a force (referred to as P2) for lifting the valve body 45 and thus the valve rod 32 upwardly is generated on an upper surface of the valve body 45. In this case, since P2>P1, the valve body 45 and thus the valve rod 32 are slid upwardly, thereby opening the flow-in port 29*a*. Consequently, the liquid from the flow-in pipe 23 flows into the liquid chamber 31 through the flow-in port 29*a* and then reaches the diaphragm pump 1 through the flow-out port 29*b* and the communication pipe 26, thereby replenishing (or supplying) a predetermined amount of the liquid corresponding to an amount of the liquid flowing into the right outer chamber 7*b*.

Then, when the central rod 3 starts to be slid rightwardly by a predetermined distance from the position shown in FIG. 1, since the negative pressure in the right outer chamber 7*b* disappears to stop the flowing of the liquid into the right outer chamber 7*b*, the negative pressure in the liquid chamber 31 also disappears through the communication pipe 26. Consequently, due to the pressure difference P1, the valve body 45 and thus the valve rod 32 is slid downwardly in FIG. 4, thereby closing the flow-in port 29*a*.

Then, when the central rod 3 continues to further slide to the right exceeding the predetermined distance, since the liquid is pushed out of the right outer chamber 7*b* and the negative pressure is generated in the left outer chamber 7*a* to flow the liquid into the left outer chamber 7*a*, similarly, negative pressure is generated in the liquid chamber 31 of the safety valve apparatus 25. Consequently, since the valve body 45 slides upwardly again to establish the valve open condition, the predetermined amount of the liquid to be replenished into the left outer chamber 7*a* of the diaphragm pump 1 flows through the flow-in port 29*a* into the liquid chamber 31. In this way, as the central rod 3 is reciprocated continuously, the liquid 21 in the tank 22 is continuously supplied to the diaphragm pump 1 through the safety valve apparatus 25, and then, the continuous pumping-out is effected.

Figure 5:
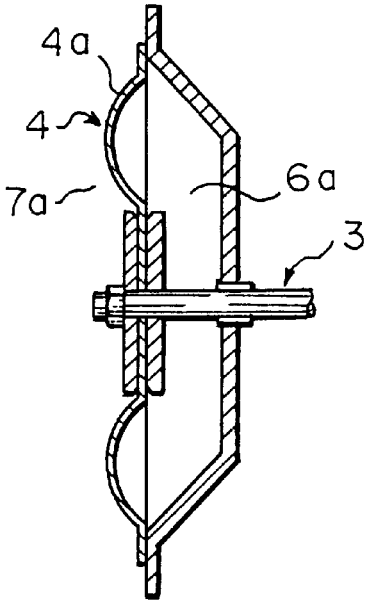
FIG. 5 is a sectional view of a main portion of the apparatus of FIG. 4 before operation.
Figure 6:
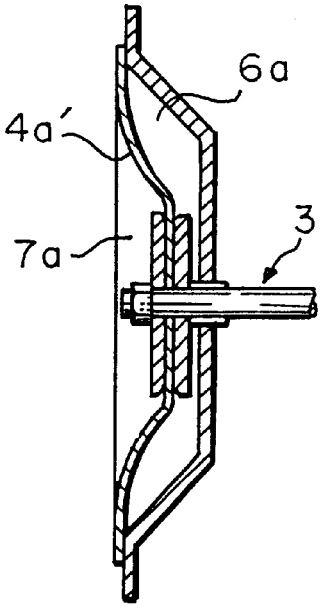
FIG. 6 is a sectional view of a main portion of the apparatus of FIG. 4 after operation.

According to the above explanation, whenever the liquid is pumped out by reciprocally sliding the central rod 3 of the diaphragm pump 1, the flow-in port 29*a* of the safety valve apparatus 25 is closed, with the result that the negative pressure is always generated in the outer chamber 7*a* or 7*b* (suction side) of the diaphragm pump 1. Thus, the diaphragm 4 of the diaphragm pump 1 assumes an outwardly convex configuration 4*a* at a slide start position (for the rightward sliding) as shown in FIG. 5 and maintains the outwardly convex configuration 4*a*' at a slide complete position (for the rightward sliding) as shown in FIG. 6 without suddenly reversing the diaphragm toward the inner chamber (air chamber) 6. This is also true when the leftward sliding is effected. Accordingly, since the diaphragm 4 is not reversed suddenly while the central rod 3 is being reciprocated, fatigue or cracking is not generated in the diaphragm.

Further, if the diaphragm 4 of the diaphragm pump 1 happens to be damaged for any reason, the liquid chamber 31 of the safety valve apparatus 25 is immediately communicated with the exterior of the diaphragm pump through damaged portion of the diaphragm, thereby bringing the pressure in the liquid chamber 31 to atmospheric pressure. Consequently, since the valve body 45 will be slid downwardly due to the pressure difference P1, the liquid flow-in port 29*a* is immediately closed to block the further flowing-out of the liquid from the diaphragm pump 1 to the exterior, thereby preventing the danger of contaminating the surrounding environment.

As mentioned above, according to the present invention, the following advantages can be obtained.

① When the liquid is pumped out by reciprocally sliding the central rod 3 of the diaphragm pump 1, due to the function of the safety valve apparatus, since the negative pressure is always generated in the outer chamber 7*a* or 7*b* (suction side) of the diaphragm pump, the diaphragm 4 of the diaphragm pump can be reciprocated while maintaining the outwardly convex configuration, and, accordingly, the service life and reliability can be improved without generating fatigue or cracks in the diaphragm.

② If the diaphragm 4 of the diaphragm pump is damaged for any reason, the liquid chamber 31 of the safety valve apparatus is immediately communicated with the exterior of the diaphragm pump through the damaged portion of the diaphragm, thereby bringing the pressure in the liquid chamber to the atmospheric pressure. Therefore, the liquid flow-in port 29*a* of the safety valve apparatus is immediately closed to block the further flowing-out of the liquid from the diaphragm pump to the exterior, thereby preventing the danger of contaminating the surrounding environment, and thus maintaining a clean environment.

What is claimed is:

1. A safety valve apparatus for feeding liquid from a tank to a diaphragm pump in which a central rod to which at least one pumping diaphragm is attached is reciprocally slidable by air pressure to forcibly pump out the liquid, said safety valve apparatus comprising:

a housing defining a space, a liquid balance port that is always providing communication between said space and the tank, a liquid chamber, a liquid flow-in port through which the liquid from the tank flows into said liquid chamber, and a liquid flow-out port through which the liquid from the tank flows out of said liquid chamber;

a valve rod slidably disposed in said housing, said valve rod having a first end disposed in said liquid chamber and a second end disposed in said space;

a valve body connected to said first end of said valve rod for opening and closing said liquid flow-in port; and a diaphragm disposed within said space and being attached between said second end of said valve rod and an inner peripheral wall of said space in order to partition said space into at least a liquid balance chamber communicating with said liquid balance port and another chamber, wherein an effective liquid pressure receiving area of said diaphragm is larger than an effective liquid pressure receiving area of said valve body, so that, when said diaphragm pump is in an inoperative condition, said valve rod slides toward said liquid chamber to close said liquid flow-in port, and, when said diaphragm pump is operated to generate negative pressure in said liquid chamber, said valve rod slides toward said liquid balance chamber to open said liquid flow-in port.

2. A safety valve apparatus as claimed in claim 1, wherein said another chamber is an air chamber that is in communication with the atmosphere.

3. A safety valve apparatus as claimed in claim 1, further comprising a bellows disposed in said liquid chamber and enclosing said first end of said valve rod to seal said valve rod in a liquid-tight condition with respect to said liquid chamber.

4. A safety valve apparatus as claimed in claim 3, wherein said bellows is secured to said valve body via a torsion ring.

5. A safety valve apparatus as claimed in claim 2, further comprising a bellows disposed in said liquid chamber and enclosing said first end of said valve rod to seal said valve rod in a liquid-tight condition with respect to said liquid chamber.

6. A safety valve apparatus as claimed in claim 5, wherein said bellows is secured to said valve body via a torsion ring.

* * * * *